US009039390B2

(12) United States Patent
Lee et al.

(10) Patent No.: US 9,039,390 B2
(45) Date of Patent: May 26, 2015

(54) COMPRESSOR

(75) Inventors: Kang-Wook Lee, Changwon-si (KR); Jang-Woo Lee, Changwon-si (KR); Bum-Dong Sa, Gimhae-si (KR); Jin-Ung Shin, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 289 days.

(21) Appl. No.: 13/388,116

(22) PCT Filed: Dec. 2, 2009

(86) PCT No.: PCT/KR2009/007167

§ 371 (c)(1),
(2), (4) Date: Jan. 31, 2012

(87) PCT Pub. No.: WO2011/019115

PCT Pub. Date: Feb. 17, 2011

(65) Prior Publication Data

US 2012/0128511 A1 May 24, 2012

(30) Foreign Application Priority Data

Aug. 10, 2009 (KR) ..... 10-2009-0073284
Aug. 10, 2009 (KR) ..... 10-2009-0073285
Aug. 10, 2009 (KR) ..... 10-2009-0073289

(51) Int. Cl.
*F04B 35/04* (2006.01)
*F01C 21/02* (2006.01)
(Continued)

(52) U.S. Cl.
CPC ..... *F01C 21/02* (2013.01); *F04C 18/322* (2013.01); *F04C 18/3564* (2013.01);
(Continued)

(58) Field of Classification Search
CPC . F04C 18/356; F04C 18/3562; F04C 2240/40
USPC ..... 417/356, 410.3; 418/63, 248, 64, 65, 66
See application file for complete search history.

(56) References Cited

U.S. PATENT DOCUMENTS 1,223,919 A * 4/1917 Wilson ..... 417/356
2,187,033 A * 1/1940 Hubacker ..... 310/86
(Continued)

FOREIGN PATENT DOCUMENTS

CN 101326370 * 12/2008 ..... F04C 18/32
JP 61-187591 8/1986
(Continued)

OTHER PUBLICATIONS

International Search Report issued in PCT Application No. PCT/KR2009/007167 dated Feb. 19, 2010.
(Continued)

*Primary Examiner* — Bryan Lettman
*Assistant Examiner* — Timothy P Solak
(74) *Attorney, Agent, or Firm* — Ked & Associates LLP

(57) ABSTRACT

A compressor is provided in which a rotary member suspended on a stationary member is rotated to compress a refrigerant. The rotary member is suspended on a first stationary member and rotatably supported on a second stationary member spaced apart from the first stationary member, to thereby achieve structural stability, improve operation reliability, and reduce vibration. The components can be easily centered and assembled with an excellent assembly property. In addition, a mounting structure of an elastically-supported vane is improved to ensure lubrication performance and operation reliability. Moreover, a mounting structure of a roller-incorporated vane is improved to reduce vibration and prevent refrigerant leakage, which leads to high compression efficiency.

10 Claims, 11 Drawing Sheets

(51) Int. Cl.

| | |
|---|---|
| ***F04C 18/32*** | (2006.01) |
| ***F04C 18/356*** | (2006.01) |
| ***F04C 23/00*** | (2006.01) |
| ***F04C 23/02*** | (2006.01) |
| ***F04C 29/00*** | (2006.01) |
| ***F04C 29/02*** | (2006.01) |

(52) U.S. Cl.

CPC ..... *F04C 23/008* (2013.01); *F04C 23/02* (2013.01); *F04C 29/0071* (2013.01); *F04C 29/0085* (2013.01); *F04C 29/023* (2013.01); *F04C 2230/603* (2013.01); *F04C 2240/10* (2013.01); *F04C 2240/30* (2013.01); *F04C 2240/40* (2013.01); *F04C 2240/52* (2013.01); *F04C 2240/60* (2013.01); *F04C 2270/12* (2013.01)

(56) References Cited

U.S. PATENT DOCUMENTS

| | | | | |
|---|---|---|---|---|
| 2,420,124 | A * | 5/1947 | Coulson | 417/356 |
| 2,440,593 | A * | 4/1948 | Miller | 418/88 |
| 2,670,894 | A * | 3/1954 | Warrick et al. | 417/356 |
| 2,871,793 | A * | 2/1959 | Michie et al. | 417/356 |
| 4,543,046 | A * | 9/1985 | Hasegawa | 418/63 |
| 5,577,903 | A | 11/1996 | Yamamoto | |
| 6,329,731 | B1 * | 12/2001 | Arbanas et al. | 310/52 |
| 7,217,110 | B2 * | 5/2007 | Dreiman | 418/173 |
| 2004/0005236 | A1 | 1/2004 | Lee | |
| 2005/0031465 | A1 | 2/2005 | Dreiman et al. | |
| 2005/0201884 | A1 | 9/2005 | Dreiman | |
| 2007/0065324 | A1 * | 3/2007 | Masuda | 418/29 |
| 2010/0226796 | A1 | 9/2010 | Kanayama et al. | |

FOREIGN PATENT DOCUMENTS

| | | |
|---|---|---|
| JP | 62-284985 | 12/1987 |
| JP | 63-100291 | 5/1988 |

OTHER PUBLICATIONS

European Search Report dated Apr. 14, 2014.

Chinese Office Action dated Dec. 19, 2013. (translation).

* cited by examiner

COMPRESSOR

TECHNICAL FIELD

The present invention relates to a compressor in which a rotary member suspended on a first stationary member and supported on a second stationary member is rotated to compress the refrigerant, and more particularly, to a compressor which can achieve the structural stability, improve an assembly property, enhance the lubrication performance and the operation reliability, and reduce vibration and prevent refrigerant leakage to ensure the compression efficiency.

BACKGROUND ART

In general, a compressor is a mechanical apparatus receiving power from a power generation apparatus such as an electric motor, a turbine or the like, and compressing the air, refrigerant or various working gases to raise a pressure. The compressor has been widely used for electric home appliances such as refrigerators and air conditioners, and application thereof has been expanded to the whole industry.

The compressors are roughly classified into a reciprocating compressor in which a compression space into/from which a working gas is sucked and discharged is defined between a piston and a cylinder and the piston is linearly reciprocated in the cylinder to compress the refrigerant, a rotary compressor in which a working gas is compressed in a compression space defined between an eccentrically-rotated roller and a cylinder, and a scroll compressor in which a compression space into/from which a working gas is sucked and discharged is defined between an orbiting scroll and a fixed scroll and the orbiting scroll is rotated along the fixed scroll to compress the refrigerant.

While the reciprocating compressor has excellent mechanical efficiency, this reciprocating motion causes serious vibration and noise problems. In order to solve the foregoing problems, the rotary compressor has been developed due to its compact structure and excellent vibration characteristic.

The rotary compressor is configured such that a motor unit and a compression mechanism unit are mounted on a driving shaft in a hermetic container. A roller located near an eccentric portion of the driving shaft is located in a cylinder defining a cylindrical compression space, one or more vanes extend between the roller and the compression space to partition the compression space into a suction region and a compression region, and the roller is eccentrically located in the compression space. In general, the vane is supported on a groove portion of the cylinder by a spring to pressurize a surface of the roller, and the compression space is partitioned into the suction region and the compression region by the vane as mentioned above. With the rotation of the driving shaft, the suction region is gradually increased such that the refrigerant or working fluid is sucked into the suction region, and at the same time, the compression region is gradually decreased such that the refrigerant or working fluid therein is compressed.

In the conventional rotary compressor, since the motor unit and the compression mechanism unit are stacked on the upper and lower sides, the overall height of the compressor is inevitably increased. Moreover, in the conventional rotary compressor, since the motor unit and the compression mechanism unit have different weights, a difference in the force of inertia and a problem of unbalance are generated on the upper and lower sides of the driving shaft. Therefore, in order to compensate for the unbalance between the motor unit and the compression mechanism unit, a weight member may be superimposed on a relatively small weight side. However, this applies an additional load to a rotary body, thereby reducing the driving efficiency and the compression efficiency. Further, in the conventional rotary compressor, the eccentric portion is formed on the driving shaft in the compression mechanism unit. The eccentric portion is rotated with the rotation of the driving shaft to drive the roller located outside the eccentric portion. As a result, the vibration is inevitably generated in the compression mechanism unit due to the eccentric rotation of the driving shaft and the eccentric portion. Furthermore, in the conventional rotary compressor, when the eccentric portion of the driving shaft is rotated, it is continuously in sliding-contact with an inner surface of the cylinder with the roller fixed thereto and a tip section of the vane with the roller fixed thereto. A high relative velocity is present between the components brought into sliding-contact, which generates a friction loss and leads to reduction of the efficiency of the compressor. Additionally, a refrigerant leakage probability is present on a sliding-contact surface between the vane and the roller, which degrades the mechanical reliability.

While the conventional rotary compressor is configured such that the driving shaft is rotated in the stationary cylinder, a rotary compressor disclosed in Japanese Patent Publication Nos. 62-284985 and 63-100291 includes: a stationary shaft having a shaft and a piston portion which are integrally formed, the shaft having an inlet port in the shaft line direction, the piston portion being eccentric at a larger diameter than that of the shaft and having a port in the radial direction to communicate with the inlet port of the shaft; a vane installed to protrude and retreat; a rotor which is rotatable with the vane accommodated therein; an upper bearing having an outlet port; a lower bearing; a permanent magnet formed in a hollow cylindrical shape with a height greater than a difference between an outer diameter and an inner diameter and fixed to the lower bearing; and a coil which is not rotated on the outer circumference of the permanent magnet. The upper bearing, the rotor and the lower bearing are rotatably connected in order, and the vane encloses the space between the rotor and the upper bearing and the lower bearing and the piston portion. There is a change in volume.

In the rotary compressor disclosed in the above Japanese Patent Publications, the hollow cylindrical permanent magnet is located inside the stator, and the rotor including the vane and the compression mechanism unit are located inside the permanent magnet. Accordingly, this rotary compressor is considered to solve the problem of the conventional rotary compressor generated because the motor unit and the compression mechanism unit are installed in the height direction.

However, in the rotary compressor disclosed in the above Japanese Patent Publications, the vane is elastically supported on the rotating rotor and is in sliding-contact with an outer surface of the stationary eccentric portion (piston portion). Like the conventional rotary compressor, a large relative velocity difference is present between the vane and the eccentric portion (piston portion), which generates a friction loss, and a refrigerant leakage probability is still present on sliding-contact surfaces of the vane and the eccentric portion. Moreover, the rotary compressor disclosed in the above Japanese Patent Publications does not suggest any realizable structure for suction and discharge passages of a working fluid, lubrication oil feeding in the compression mechanism unit, or mounting of a bearing member, and thus does not reach the stage of practical application.

Meanwhile, U.S. Pat. No. 7,217,110 discloses a rotary compressor in which a stationary shaft and an eccentric portion are integrally formed and a compression space is defined between an outer surface of a roller rotatably located on the eccentric portion and an inner surface of a rotating rotor. Here, a rotation force of the rotor is transferred to the roller through a vane fixed to upper and lower plates of the rotor and integrally rotated with the rotor, and a working fluid and lubrication oil are introduced into the compression space through a longitudinal passage formed in the center of the stationary shaft using a difference between an inner pressure of a hermetic container and an inner pressure of the compression space.

Also in the rotary compressor disclosed in the above U.S. Patent Publication, a compression mechanism unit is formed inside the rotor. Accordingly, this rotary compressor is considered to solve the problem of the conventional rotary compressor generated because the motor unit and the compression mechanism unit are installed in the height direction. Further, unlike the Japanese patent publications, the rotor, the vane and the roller are integrally rotated, and thus do not have a relative velocity difference, thus preventing a friction loss.

However, in the rotary compressor disclosed in the above U.S. Patent Publication, one end portion of the stationary shaft is fixed to the hermetic container, but the other end thereof is spaced apart from the hermetic container and suspended on the hermetic container. It is thus difficult to center the stationary shaft. There are other problems such as weakness to the horizontal direction vibration caused by the eccentric rotation which is an inevitable characteristic of the rotary compressor, difficulty in manufacturing, or degradation of assembly productivity. Additionally, since the vane inwardly protrudes from the rotor and a vane groove is formed in the roller to guide a traveling track of the vane, the volume of the roller is inevitably increased to form the vane groove. The roller of a relatively large volume excites the horizontal direction vibration by the eccentric rotation. A structure not using the lubrication oil has also been disclosed. For this purpose, components should be formed of very expensive materials. With respect to a structure using the lubrication oil, the lubrication oil is lifted into the compression space using a difference between an inner pressure of the hermetic container and an inner pressure of the compression space and circulated with a working fluid. In this situation, a lot of lubrication oil may be inevitably incorporated in the working fluid and discharged from the compressor with the working fluid, which degrades the lubrication performance.

DISCLOSURE

Technical Problem

The present invention has been made in an effort to solve the above-described problems of the prior art, and an object of the present invention is to provide a compressor in which components can be easily centered and assembled in a hermetic container, thus improving the structural safety.

Another object of the present invention is to provide a compressor which can reduce the horizontal direction vibration caused by the eccentric rotation, enhance the efficiency, and simplify the actual production assembly.

A further object of the present invention is to provide a compressor in which a rotary member can be stably supported on a stationary member and smoothly rotated.

A still further object of the present invention is to provide a compressor which can be reduced in height, although a rotor and a cylinder are stacked.

A still further object of the present invention is to provide a compressor which can facilitate the lubrication by improving a mounting structure of a vane brought into sliding-contact with a roller and elastically supported on a cylinder.

A still further object of the present invention is to provide a compressor which can reduce the vibration by improving a roller-incorporated vane mounting structure.

A still further object of the present invention is to provide a compressor which can facilitate the lubrication by improving a roller-incorporated vane mounting structure.

Technical Solution

According to an aspect of the present invention for achieving the above objects, there is provided a compressor, including: a hermetic container into/from which the refrigerant is sucked and discharged; a stator fixed to an inner surface of the hermetic container; a first stationary member including a stationary shaft having a top end immovably installed in the hermetic container and being elongated into the hermetic container; a second stationary member spaced apart from a bottom end of the first stationary member and immovably installed at a low portion of the hermetic container; and a rotary member located inside the stator, rotated around the first stationary member by a mutual electromagnetic force between the rotor and the stator, compressing the refrigerant sucked into a compression space defined therein, and rotatably supported by applying a load to the second stationary member.

In addition, the first stationary member further includes an eccentric portion eccentric from the center of the stationary shaft, and the rotary member further includes a rotor rotated by the mutual electromagnetic force between the rotor and the stator, a cylinder stacked below the rotor, rotated with the rotor, and having a compression space therein, a vane elastically supported on the cylinder to partition the compression space between the eccentric portion and the cylinder into a suction pocket into which the refrigerant is sucked and a compression pocket in/from which the refrigerant is compressed and discharged, and upper and lower bearing covers forming upper and lower portions of the compression space and rotating around the first stationary member with the rotary member.

Moreover, the upper bearing cover includes a cylinder coupling portion, the cylinder being fastened to a bottom surface of a central portion thereof, and a rotor coupling portion, the rotor being fastened to a top surface of the circumference of the cylinder coupling portion, and the upper bearing cover has a stepped portion such that the cylinder coupling portion is more protruded than the rotor coupling portion in the upward direction to fit the rotor thereonto.

Further, a slot-shaped vane mounting hole is provided in an inner circumferential surface of the cylinder to be elongated in the radial direction and the up-down direction, and the vane is inserted into the vane mounting hole and supported by a vane spring.

Furthermore, a vane escape protrusion portion is provided on the cylinder to protrude from an outer circumferential surface of the cylinder, and the vane escape protrusion portion includes an opening communicating with the vane mounting hole and supplying the oil filled in the hermetic container.

Still furthermore, the first stationary member further includes an eccentric portion eccentric from the center of the stationary shaft, and the rotary member further includes a cylinder-type rotor rotated around the stationary shaft by a rotating electromagnetic field from the stator, a roller applied with a rotation force of the cylinder-type rotor, rotated around the eccentric portion with the cylinder-type rotor, and defining a compression space between the roller and the cylinder-type rotor, a vane protruding from an outer circumferential surface of the roller, fitted into an inner circumferential surface of the cylinder-type rotor, transferring the rotation force from the cylinder-type rotor to the roller, and partitioning the compression space into a suction pocket into which the refrigerant is sucked and a compression pocket in/from which the refrigerant is compressed and discharged, and upper and lower bearing covers forming upper and lower portions of the compression space and rotating around the first stationary member with the rotary member.

Still furthermore, the cylinder-type rotor includes a cylinder defining a compression space between the cylinder and the roller, and a rotor formed by staking iron pieces in the axial direction such that permanent magnets are inserted into a plurality of holes formed in the stacked body to face the stator, the cylinder and the rotor being shape-matched with each other.

Still furthermore, a vane mounting hole accommodating the vane is provided in the cylinder-type rotor, a bush guiding both side surfaces of the vane linearly reciprocated with the rotation of the cylinder-type rotor is provided in the vane mounting hole, and at least a part of the vane mounting hole is not covered with the lower bearing cover such that the oil stored in the hermetic container is supplied thereto.

Still furthermore, the upper bearing cover includes an upper shaft portion enclosing the stationary shaft and an upper cover portion coupled to the cylinder to form the upper portion of the compression space, an inner circumferential surface of the upper shaft portion is rotatably journal-supported on an outer circumferential surface of the stationary shaft, and a bottom surface of the upper cover portion is rotatably thrust-supported on a top surface of the eccentric portion.

Still furthermore, the lower bearing cover includes a lower shaft portion enclosing the stationary shaft and a lower cover portion coupled to the cylinder to form the lower portion of the compression space, an inner circumferential surface of the lower shaft portion is rotatably journal-supported on an outer circumferential surface of the stationary shaft, and a top surface of the lower cover portion is rotatably thrust-supported on a bottom surface of the eccentric portion.

Still furthermore, the lower shaft portion is more extended than the bottom end of the stationary shaft, and an end portion thereof is rotatably supported by applying a load of the rotary member to the second stationary member.

Still furthermore, the second stationary member further includes a cylindrical bearing portion having a stepped portion therein, a bottom end portion of the lower shaft portion is thrust-supported on the stepped portion of the second stationary member, and an outer circumferential surface of the lower shaft portion is journal-supported on an inner circumferential surface of the cylindrical bearing portion.

Still furthermore, a separate thrust bearing member is provided between the bottom end portion of the lower shaft portion and the stepped portion of the second stationary member.

Still furthermore, the compressor further includes an upper shaft holder provided on a top surface of the hermetic container such that a top end of the stationary shaft is fixed thereto.

Still furthermore, the hermetic container is formed in the shape of a cylinder with a circular cross-section, and the second stationary member is fixed to one or more of the side and bottom surfaces of the hermetic container by welding.

Advantageous Effects

In the compressor according to the present invention, the rotary member is suspended on the stationary member, the stationary member is fixed to the upper shaft holder, the rotary member is rotatably supported on the lower shaft holder, and the upper and lower shaft holders are fixed to the hermetic container. As such, the components can be easily centered and assembled in the hermetic container, which leads to high structural safety and easy assembly.

Additionally, in the compressor according to the present invention, although the eccentric portion is eccentric from the center of the stationary shaft, it protrudes in the entire radial direction of the stationary shaft and maintains a still state. Since the rotary member is rotated around the stationary shaft or the eccentric portion, the eccentric rotation does not occur. As a result, it is possible to reduce the horizontal direction vibration caused by the eccentric rotation and omit the balance weight for, reducing the vibration caused by the eccentric rotation. This improves efficiency and simplifies the actual production assembly.

Moreover, in the compressor according to the present invention, the rotary member is suspended on the first stationary member and rotatably supported on the second stationary member spaced apart from the first stationary member, and the bearings are employed on the contact surfaces thereof. Therefore, the rotary member is stably supported due to the increase of the contact area of the rotary member and the first and second stationary members and smoothly rotated with respect to the first and second stationary members due to the operation of the bearings on the contact surfaces. This can reduce a friction loss.

Further, in the compressor according to the present invention, the rotor and the cylinder are stacked with the upper bearing cover therebetween. The upper bearing cover is provided with the stepped portion such that the rotor coupling portion is thinner than the cylinder coupling portion. Accordingly, although the rotor and the cylinder are stacked, the product height can be reduced.

Furthermore, in the compressor according to the present invention, the vane and the vane spring are assembled in the vane mounting hole penetrating through the inner/outer circumferential surface of the cylinder, and a vane spring stopper is fixed to the outer circumferential surface of the cylinder to block the vane mounting hole. The vane spring stopper is provided with a hole for supplying the lubrication oil. This improves the mounting structure of the vane to enhance the lubrication performance of the vane and the operation reliability of the vane.

Still furthermore, in the compressor according to the present invention, the vane is integrally formed with the outer circumferential surface of the roller and fitted into the vane mounting hole provided in the inner circumferential surface of the cylinder-type rotor. This prevents the excessive size increase of the roller and the vibration caused by the eccentric rotation of the roller, which are generated because the vane mounting hole is provided in the roller. As the vane mounting hole is provided in the cylinder-type rotor having a larger volume than that of the roller, there is an advantage such as simplification of the actual production assembly.

Still furthermore, in the compressor according to the present invention, although the vane mounting hole is provided in the cylinder-type rotor and the lower bearing cover is mounted at the lower portion of the cylinder-type rotor, the lower bearing cover is installed without covering a part of the vane mounting hole. Therefore, the oil stored in the hermetic container is introduced directly into the vane mounting hole of the cylinder-type rotor. This facilitates the lubrication to enhance the operation reliability.

BEST MODE FOR CARRYING OUT INVENTION

Figure 1:
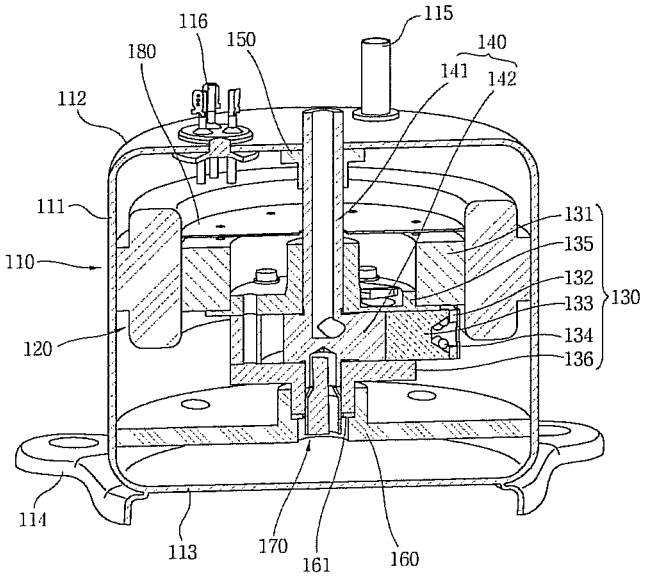
FIG. 1 is a side-sectional view of a first embodiment of a compressor according to the present invention.
Figure 2:
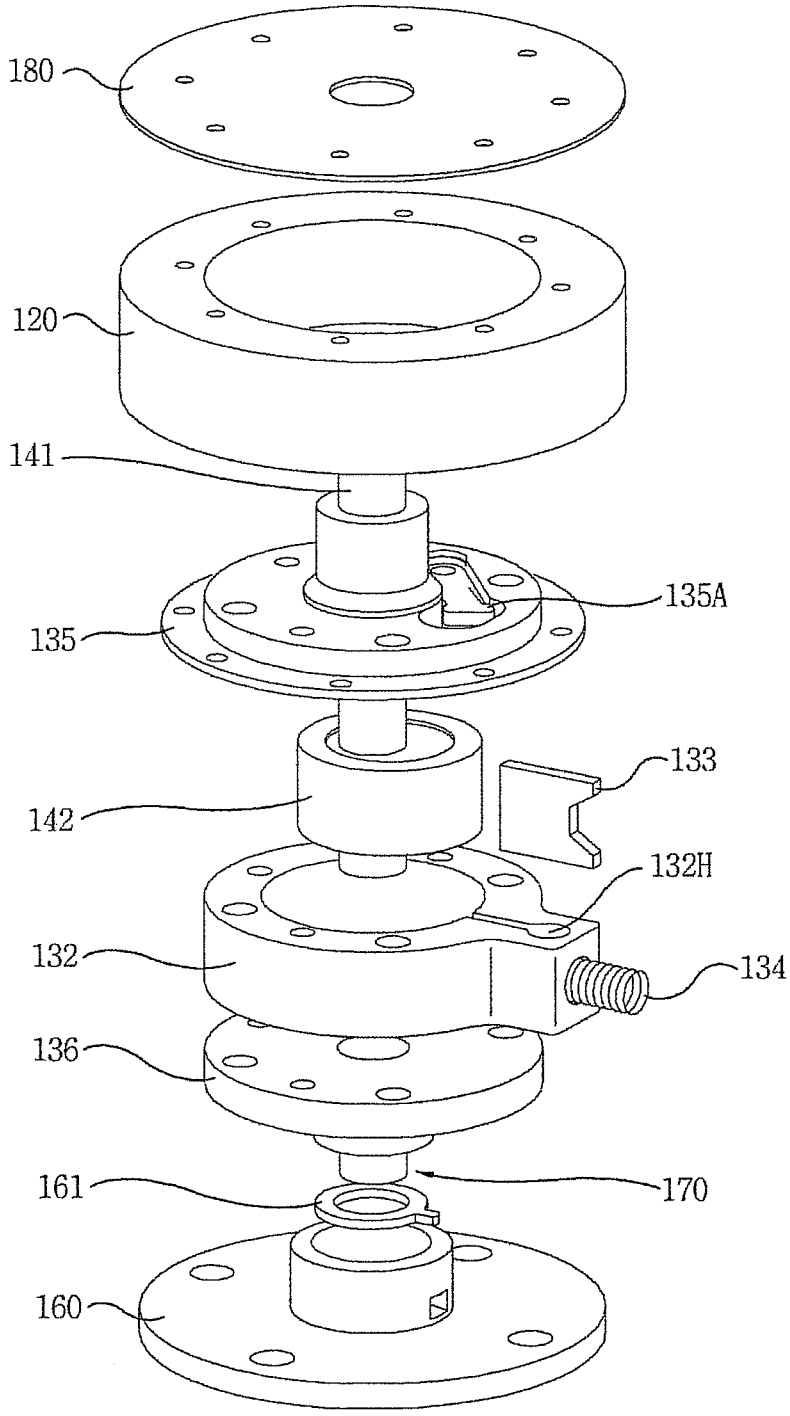
FIG. 2 is an exploded perspective view of the first embodiment of the compressor according to the present invention.
Figure 3:
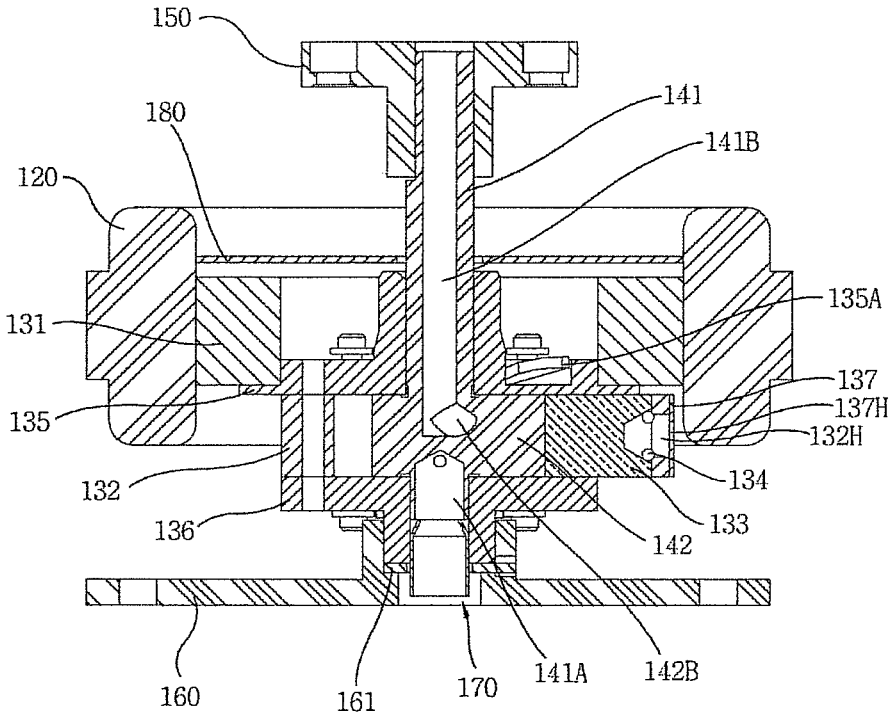
FIG. 3 is a side-sectional view of the first embodiment of the compressor according to the present invention.

FIGS. 1 to 3 are views of a first embodiment of a compressor according to the present invention.

As illustrated in FIGS. 1 to 3, the first embodiment of the compressor according to the present invention includes a hermetic container 110, a stator 120 fixed in the hermetic container 110, a rotary member 130 installed inside the stator 120 to be rotated by a rotating electromagnetic field from the stator 120 and compressing the refrigerant, a stationary member 140, the rotary member 130 being suspended on its outer circumferential surface, top and bottom ends of a stationary shaft 141 being immovably fixed to the hermetic container 110, an upper shaft holder 150 fixing the top end of the stationary shaft 141 to the inside of the hermetic container 110, and a lower shaft holder 160 spaced apart from the bottom end of the stationary shaft 141 and fixed to the inside of the hermetic container 110 such that the rotary member 130 is rotatably supported on its top surface. Here, a motor mechanism unit supplying power through an electrical action includes the stator 120 and a rotor 131 of the rotary member 130, and a compression mechanism unit compressing the refrigerant through a mechanical action includes the rotary member 130 and the stationary member 140. Therefore, the motor mechanism unit and the compression mechanism unit are partially stacked in the up-down direction and installed in the radial direction, which reduces the overall height of the compressor.

The hermetic container 110 includes a cylindrical body portion 111, upper and lower shells 112 and 113 coupled to upper and lower portions of the body portion 111, and a mounting portion 114 provided on a bottom surface of the lower shell 113 in the radial direction to fixedly fasten the hermetic container 110 to another product. The oil lubricating the rotary member 130 and the stationary member 140 can be stored in the hermetic container 110 at a proper height. The stationary shaft 141 is provided in the center of the upper shell 112 to be exposed therefrom, which is an example of a suction pipe (not shown) through which the refrigerant is sucked, and a discharge pipe 115 through which the refrigerant is discharged is provided in a given position of the upper shell 112. The compressor is determined as a high-pressure type or a low-pressure type according to whether the hermetic container 110 is filled with the compression refrigerant or pre-compression refrigerant. As such, the suction pipe and the discharge pipe may be reversed. In the embodiment of the present invention, the compressor is a high-pressure type and the stationary shaft 141 which is the suction pipe is provided to protrude to the outside of the hermetic container 110. However, there is no need that the stationary shaft 141 should excessively protrude to the outside of the hermetic container 110. Preferably, an appropriate fixing structure is installed on the outside of the hermetic container 110 and connected to an external refrigerant pipe. Additionally, a terminal 116 supplying power to the stator 120 is provided on the upper shell 112.

The stator 120 includes a core and a coil intensively wound on the core and is fixed to the inside of the body portion 111 of the hermetic container 110 by shrinkage fitting. A core employed in a general Brushless Direct Current (BLDC) motor has 9 slots along the circumference. In the preferred embodiment of the present invention, the diameter of the stator 120 is relatively increased such that the core of the BLDC motor has 12 slots along the circumference. The more the slots of the core, the larger the winding number of the coil. Even if the height of the core is reduced, it is possible to produce an electromagnetic force of a general stator.

The rotary member 130 includes a rotor 131, a cylinder 132, a vane 133, a vane spring 134, an upper bearing cover 135 and a lower bearing cover 136. The rotor 131 is provided with a plurality of permanent magnets to be rotated by the rotating electromagnetic field from the stator 120 and installed inside the stator 120 to maintain a gap therefrom. The cylinder 132 is formed in a cylindrical shape with a compression space therein. A vane mounting hole 132H is formed in an inner circumferential surface of the cylinder 132 to be elongated in the radial direction such that the vane 133 and the vane spring 134 are mounted therein. The rotor 131 and the cylinder 132 are stacked in the up-down direction with the upper bearing cover 135 therebetween to be integrally rotated. The vane 133 has one end supported on an outer circumferential surface of an eccentric portion 142 described below and the other end elastically supported in the vane mounting hole 132H of the cylinder 132 by the vane spring 134. The vane 133 partitions a compression space between the cylinder 132 and the eccentric portion 142 into a suction pocket S (see FIG. 4) into which the refrigerant is sucked and a compression pocket D (see FIG. 4) in/from which the refrigerant is compressed and discharged. Preferably, a lubrication structure is applied such that the vane 133 is smoothly moved between the eccentric portion 142 and the vane mounting hole 132H of the cylinder 132.

The upper bearing cover 135 is in journal-bearing or thrust-bearing contact with the stationary member 140 and coupled to stack the rotor 131 and the cylinder 132 in the up-down direction. Here, an outer circumferential portion of a top surface of the upper bearing cover 135 is provided with a stepped portion such that the rotor 132 is fastened thereto. The rotor 131 is put on the stepped portion of the outer circumference of the top surface of the upper bearing cover 135 and bolt-fastened thereto, and the cylinder 132 is bolt-fastened to the center of a bottom surface of the upper bearing cover 135. Additionally, an outlet port (not shown) through which the refrigerant compressed in the compression space can be discharged and a discharge valve 135A installed thereon are provided at the upper bearing cover 135. Preferably, the outlet port of the upper bearing cover 135 is located adjacent to the vane 133 to reduce the dead volume. The upper bearing cover 135 is coupled to a bottom surface of the rotor 131 and a top surface of the cylinder 132, and the lower bearing cover 136 is coupled to a bottom surface of the cylinder 132. They are fastened respectively by a fastening member such as a long bolt, etc.

The stationary member 140 includes the stationary shaft 141 formed in a cylindrical shape, and the eccentric portion 142 protruding from the stationary shaft 141 in the entire radial direction of the stationary shaft 141 to have a cylindrical shape of a greater diameter than that of the cylinder of the stationary shaft 141 and eccentrically formed on the stationary shaft 141. A first oil supply passage 141A through which the oil stored in the hermetic container 110 can be supplied is formed at a lower portion of the stationary shaft 141, and a vertical suction passage 141B through which the low-pressure refrigerant can be sucked is formed at an upper portion of the stationary shaft 141. The oil supply passage 141A and the vertical suction passage 141B are isolated from each other, which prevents the oil from being discharged with the refrigerant. The eccentric portion 142 is expanded in the entire radial direction of the stationary shaft 141. A horizontal suction passage 142B is provided in the radial direction of the eccentric portion 142 and extended to an outer circumferential surface thereof to communicate with the vertical suction passage 141B of the stationary shaft 141. The vane 133 can pass through the horizontal suction passage 142B. Since top and bottom surfaces of the eccentric portion 142 are brought into contact with the upper and lower bearing covers 135 and 136 and operated as thrust surfaces, it is preferable to form a lubrication oil supply passage on the top and bottom surfaces of the eccentric portion 142, and since an outer circumferential surface of the eccentric portion 142 is brought into contact with the vane 133, it is preferable to form a lubrication oil supply passage inside the eccentric portion 142 to be extended to the outer circumferential surface thereof.

The upper and lower shaft holders 150 and 160 immovably fix the stationary shaft 141 to the hermetic container 110 and rotatably support the rotary member 130. The upper shaft holder 150 is fixed to the upper shell 112 of the hermetic container 110 by welding or the like after an upper portion of the stationary shaft 141 is fitted thereinto. The upper shaft holder 150 is smaller than the lower shaft holder 160 in the radial direction. The reason for this is to prevent the interference with the suction pipe or the terminal 116 provided on the upper shell 112. In the meantime, the lower shaft holder 160 is spaced apart from a lower portion of the stationary shaft 141 and fixed to a side surface of the body portion 111 of the hermetic container 110 by shrinkage fitting or 3-point welding after a shaft portion of the lower bearing cover 136 enclosing the lower portion of the stationary shaft 141 is rotatably supported on a thrust bearing 161. The upper and lower shaft holders 150 and 160 are manufactured by press working, but the vane 133, the upper and lower bearing covers 135 and 136, and the stationary shaft 141 and the eccentric portion 142 are manufactured by casting using cast iron, grinding and additional machining.

Figure 4:
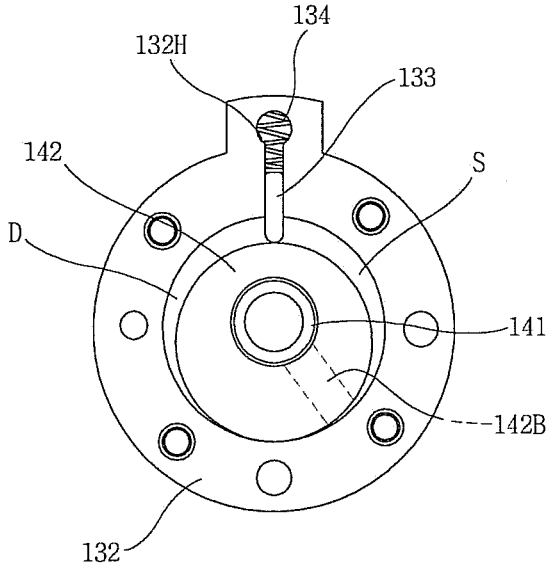
FIG. 4 is a plan-sectional view of a vane mounting structure in the first embodiment of the compressor according to the present invention.
Figure 5:
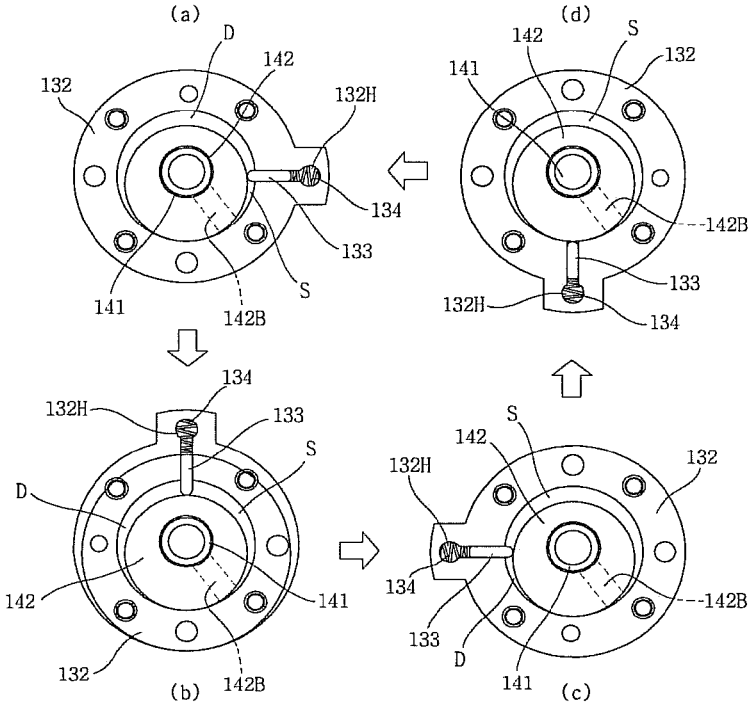
FIG. 5 is a plan view of an operation cycle of a compression mechanism unit in the first embodiment of the compressor according to the present invention.

FIG. 4 is a plan-sectional view of a vane mounting structure in the first embodiment of the compressor according to the present invention, and FIG. 5 is a plan view of an operation cycle of a compression mechanism unit in the first embodiment of the compressor according to the present invention.

The mounting structure of the vane 133 will be described with reference to FIG. 4. A vane escape protrusion portion 132A is provided at one side of an outer circumferential surface of the cylinder 132 to protrude therefrom, a vane mounting hole 132H is formed in an inner/outer circumferential surface of the cylinder 132 to be elongated in the radial direction and penetrated in the axial direction, and a vane spring stopper 137 (see FIG. 3) is provided at an outer circumferential surface of the cylinder 132 to block the vane mounting hole 132H and support the vane spring 134. Therefore, one end of the vane 133 is elastically supported in the vane mounting hole 132H by the vane spring 134 and the other end thereof is supported on the outer circumferential surface of the eccentric portion 142. Here, the vane spring stopper 137 (see FIG. 3) is provided with a hole (not shown) for supplying the oil. When the level of the oil stored in the hermetic container 110 (see FIG. 1) is maintained higher than the hole 137H of the vane spring stopper 137 (see FIG. 3), the oil can be automatically introduced into the vane mounting hole 132H through the hole of the vane spring stopper 137 (see FIG. 3) to lubricate the vane 133 linearly reciprocated therein and improve the operation reliability.

The mounted vane 133 partitions the compression space defined between the cylinder 132 and the eccentric portion 142 into the suction pocket S and the compression pocket D. The horizontal suction passage 142B of the eccentric portion 142 explained above is located to communicate with the suction pocket S, and the outlet port and the discharge valve 135A of the upper bearing cover 135 are located to communicate with the compression pocket D. As described above, they are preferably located adjacent to the vane 133 to reduce the dead volume.

Therefore, when the rotor 131 is rotated by a rotating magnetic field between the rotor 131 and the stator 120 (see FIG. 1), the cylinder 132 connected to the rotor 131 by the upper bearing cover 135 is integrally rotated. The vane 133 is elastically supported in the vane mounting hole 132H of the cylinder 132 as well as on the outer circumferential surface of the eccentric portion 142. The cylinder 132 is rotated around the stationary shaft 141, and the vane 133 is rotated around the eccentric portion 142. That is, the inner circumferential surface of the cylinder 132 and the outer circumferential surface of the eccentric portion 142 have corresponding portions. In every rotation of the cylinder 132, the corresponding portions are repeatedly brought into contact and distant positions. Accordingly, the suction pocket S is gradually increased such that the refrigerant or working fluid is sucked into the suction pocket S, and the compression pocket D is gradually decreased such that the refrigerant or working fluid therein is compressed and discharged.

The suction, compression and discharge process of the compression mechanism unit will be described. As illustrated in FIG. 5, the cylinder 132 and the vane 133 are rotated and their relative positions are changed to (a), (b), (c) and (d) during one cycle. In more detail, when the cylinder 132 and the vane 133 are located in (a), the refrigerant or working fluid is sucked into the suction pocket S and compressed in the compression pocket D separated from the suction pocket S by the vane 134. When the cylinder 132 and the vane 133 are rotated to reach (b), the suction pocket S is increased and the compression pocket D is decreased such that the refrigerant or working fluid is sucked into the suction pocket S and compressed in the compression pocket D. When the cylinder 132 and the vane 133 are rotated to reach (c), the refrigerant or working fluid is continuously sucked into the suction pocket S. If the refrigerant or working fluid has a pressure over a set pressure in the compression pocket D, it is discharged through the outlet port and the discharge valve 135A (see FIG. 2) of the upper bearing cover 135 (see FIG. 2). The suction and discharge of the refrigerant or working fluid are almost done in (d). When the position is changed from (d) to (a), the vane 133 passes through the horizontal suction passage 142B provided in the eccentric portion 142.

Figure 6:
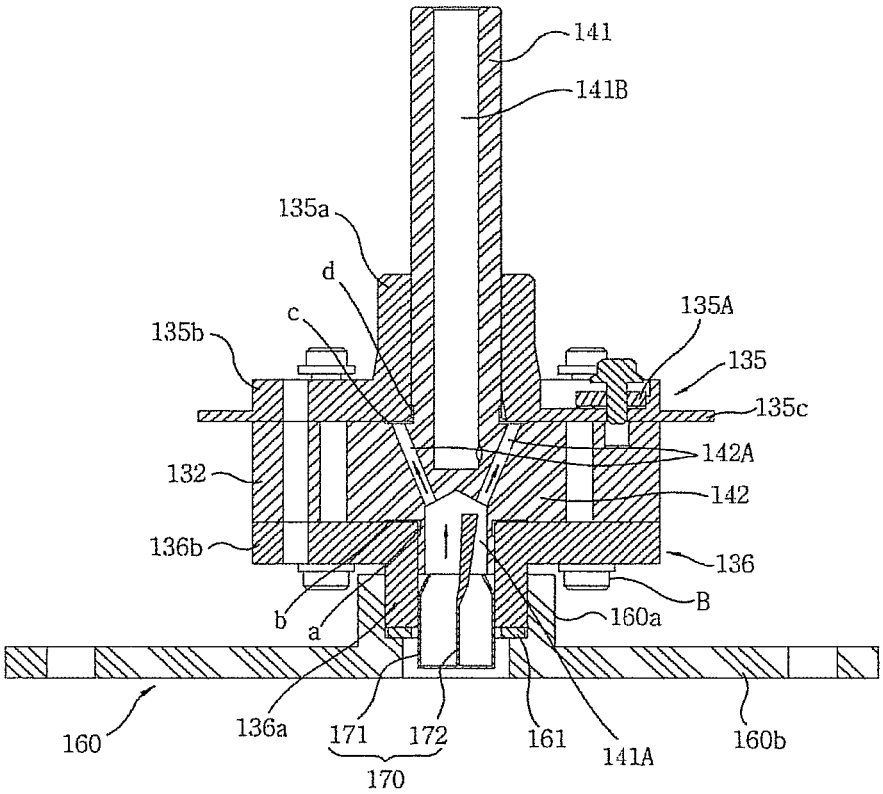
FIG. 6 is a side-sectional view of a support structure of a rotary member in the first embodiment of the compressor according to the present invention.

FIG. 6 is a side-sectional view of a support structure of the rotary member in the first embodiment of the compressor according to the present invention.

As illustrated in FIGS. 1 and 6, the rotary member 130 is rotatably suspended on the stationary member 140 and rotatably supported on the lower shaft holder 160 spaced apart from the stationary member 140.

The upper and lower bearing covers 135 and 136 are rotatably installed on the stationary member 140 and the lower shaft holder 160 such that the rotary member 130 is rotatably installed on the stationary member 140. In more detail, the upper bearing cover 135 includes an upper shaft portion 135*a* enclosing an upper portion of the stationary shaft 141, and an upper cover portion 135*b* and 135*c* brought into contact with a top surface of the eccentric portion 142. The upper cover portion 135*b* and 135*c* includes a cylinder coupling portion 135*b* having a relatively large thickness to resist the pressure of the compression space, the cylinder 132 being bolt-fastened to a bottom surface thereof, and a rotor coupling portion 135*c* having a relatively small thickness and formed on an outer circumferential surface of the cylinder coupling portion 135*b* with a stepped portion, the rotor 131 being seated on and bolt-fastened to a top surface thereof. Here, a first journal bearing journal-supporting the outer circumferential surface of the upper portion of the stationary shaft 141 is provided on an inner circumferential surface of the upper shaft portion 135*a*, and a thrust bearing thrust-supporting the top surface of the eccentric portion 142 is provided on a bottom surface of the upper cover portion 135*b* and 135*c* or the cylinder coupling portion 135*b*. As the rotary member 130 is suspended on the stationary member 140, the contact area of the upper cover portion 135*b* and 135*c* or the cylinder coupling portion 135*b* of the upper bearing cover 135 and the eccentric portion 142 is relatively large. It is thus essential to provide the first thrust bearing and preferable to provide the lubrication oil supply passage. In addition, the lower bearing cover 136 includes a lower shaft portion 136*a* enclosing a lower portion of the stationary shaft 141, and a lower cover portion 136*b* brought into contact with a bottom surface of the eccentric portion 142. Here, a second journal bearing journal-supporting the outer circumferential surface of the lower portion of the stationary shaft 141 is provided on an inner circumferential surface of the lower shaft portion 136*a*, and a second thrust bearing thrust-supporting the bottom surface of the eccentric portion 142 is provided on a top surface of the lower cover portion 136*b*. There is no need that the lower shaft portion 136*a* of the lower bearing cover 136 should be extended to the lower shaft holder 160. However, when the lower shaft portion 136*a* of the lower bearing cover 136 is extended to and supported by the lower shaft holder 160, it is possible to obtain a stable structure. Preferably, the lower shaft portion 136*a* of the lower bearing cover 136 is more extended than the lower portion of the stationary shaft 141, and its bottom surface is rotatably supported on the lower shaft holder 160. Moreover, the lower shaft holder 160 includes a cylindrical bearing portion 160*a* enclosing the lower shaft portion 136*a* of the lower bearing cover 136, and a mounting portion 160*b* expanded in the radial direction of the bearing portion 160*a* and fixedly welded to the inside of the hermetic container 110. Preferably, the lower shaft portion 136*a* of the lower bearing cover 136 is rotatably supported on the bearing portion 160*a* of the lower shaft holder 160. For example, a third journal bearing is provided on an inner surface of the bearing portion 160*a* of the lower shaft holder 160 which is brought into contact with an outer circumferential surface of the lower shaft portion 136*a* of the lower bearing cover 136, or a third thrust bearing is provided on a bottom surface of the bearing portion 160*a* of the lower shaft holder 160 which is brought into contact with a bottom end of the lower shaft portion 136*a* of the lower bearing cover 136, or a separate plate-shaped thrust bearing 161 may be provided.

Accordingly, the upper bearing cover 135 is fitted onto an upper portion of the stationary shaft 141 in the axial direction and bolt B-fastened such that a top surface of the cylinder 132 comes in contact with a bottom surface of the cylinder coupling portion 135*b* of the upper bearing cover 135, and the rotor 131 is put on the rotor coupling portion 135*c* of the upper bearing cover 135 and bolt-fastened such that a bottom surface of the rotor 131 comes in contact with a top surface of the rotor coupling portion 135*c* of the upper bearing cover 135. Additionally, the lower bearing cover 136 is fitted onto a lower portion of the stationary shaft 141 in the axial direction and bolt B-fastened such that a bottom surface of the cylinder 132 comes in contact with a top surface of the lower cover portion 136*b* of the lower bearing cover 136. The upper and lower bearing covers 135 and 136 may be fastened to the cylinder 132 at a time by a long bolt B. Therefore, when the rotary member 130 is coupled to the stationary member 140, the lower shaft portion 136*b* of the lower bearing cover 136 is fitted into the lower shaft holder 160, the top end of the stationary shaft 141 is fitted into the upper shaft holder 150, and the upper and lower shaft holders 150 and 160 are fixedly welded to the hermetic container 110, respectively.

A lubrication structure for supplying the oil stored in the hermetic container 110 is provided on contact surfaces of the rotary member 130 and the stationary member 140, i.e., contact surfaces of the upper and lower bearing covers 135 and 136, and the stationary shaft 141 and the eccentric portion 142. Here, an oil supply member 170 is provided to pump the oil stored in the hermetic container 110 such that the oil is lifted to the upper and lower bearing covers 135 and 136. The oil supply member 170 includes a cylindrical hollow shaft portion 171 fitted into the lower shaft portion 136*a* of the lower bearing cover 136, and a propeller 172 installed in the hollow shaft portion 171 to supply the oil through a passage between the propeller 172 and the hollow shaft portion 171 by a rotation force.

The lubrication structure of the lower bearing cover 136 includes a first oil supply passage 141A which is a hollow space vertically extended in a lower portion of the stationary shaft 141 to communicate with the lower shaft portion 136*a* of the lower bearing cover 136, a first oil supply hole (not shown) penetrated through the lower portion of the stationary shaft 141 in the radial direction to communicate with the first oil supply passage 141A, and first oil supply grooves a and b formed in a bottom surface of the eccentric portion 142 brought into contact with the lower bearing cover 136 and an outer circumferential surface of the stationary shaft 141 directly below the eccentric portion 142 so as to communicate with the first oil supply hole. Here, the first oil supply grooves a and b may be formed in any of the contact portions of the lower bearing cover 136, and the stationary shaft 141 and the eccentric portion 142, but are preferably formed as an annular groove portion in the outer circumferential surface of the lower portion of the stationary shaft 141 and the bottom surface of the eccentric portion 142 of a relatively large thickness and an easy machining property. Moreover, a spiral groove supplying the oil to the first oil supply grooves a and b may be provided in an inner circumferential surface of the lower shaft portion 136*a* of the lower bearing cover 136 enclosing the lower portion of the stationary shaft 141. Further, the lower shaft portion 136*a* of the lower bearing cover 136 is brought into contact with the lower shaft holder 160, but immersed in the oil. As such, there is no need to provide a special oil lubrication structure.

The lubrication structure of the upper bearing cover 135 includes a first oil supply passage 141A of the stationary shaft 141, two or more second oil supply passages 142A of the eccentric portion 142 extended to a top surface of the eccentric portion 142 to communicate with the first oil supply passage 141A of the stationary shaft 141, and second oil supply grooves c and d formed in a top surface of the eccentric portion 142 brought into contact with the upper bearing cover 135 and an outer circumferential surface of the stationary shaft 141 directly over the eccentric portion 142 so as to communicate with the second oil supply passages 142A of the eccentric portion 142. Preferably, the second oil supply passages 142A provided in the eccentric portion 142 are installed without overlapping with the horizontal suction passage 142B (see FIG. 3) provided in the eccentric portion 142. Likewise, the second oil supply grooves c and d may be formed in any of the contact portions of the upper bearing cover 135, and the stationary shaft 141 and the eccentric portion 142, but are preferably formed as an annular groove portion having a side section of '⌊' in the outer circumferential surface of the upper portion of the stationary shaft 141 and the top surface of the eccentric portion 142 of a relatively large thickness and an easy machining property.

In addition, the oil is supplied with the refrigerant to lubricate the vane 133. An oil separation plate 180 is installed to prevent the oil compressed with the refrigerant from being discharged to the outside of the hermetic container 110. Here, the oil separation plate 180 is located directly over the rotor 131. Therefore, the oil and the refrigerant discharged from the outlet port of the upper bearing cover 135 collide against the oil separation plate 180 such that the oil is separated from the refrigerant. The oil separation plate 180 may be fastened to any of the stator 120, the rotor 131, the upper bearing cover 135, and the stationary shaft 141. Thus, a kind of noise space to which the high-pressure refrigerant is discharged is defined between the rotor 131, the upper bearing cover 135 and the oil separation plate 180, which reduces the noise caused by the opening and closing of the discharge valve 135A and the noise caused by the flow of the high-pressure refrigerant. Preferably, the oil separation plate 180 is provided with a hole to discharge the high-pressure refrigerant separated from the oil, and the cylinder 132 and the upper and lower bearing covers 135 and 136 are provided with a separate oil recovery passage to separate the oil.

Accordingly, since the level of the oil stored in the lower portion of the hermetic container 110 is higher than the oil supply hole including the end of the lower shaft portion 136*a* of the lower bearing cover 136, the oil is introduced into the first oil supply passage 141A, the first oil supply hole, and the first oil supply grooves a and b. Here, as the lower shaft portion 136*a* of the lower bearing cover 136 is immersed in the oil, the oil lubricates between the lower shaft portion 136*a* and the lower shaft holder 160. The oil collected in the first oil supply grooves a and b lubricates between the rotatably-installed lower bearing cover 136, and the stationary shaft 141 and the eccentric portion 142. Moreover, as the rotary member 130 is rotated, the oil is pumped by the oil supply member 170 and introduced into the first oil supply passage 141A of the stationary shaft 141, the second oil supply passages 142A of the eccentric portion 142, and the second oil supply grooves c and d. Here, the oil collected in the second oil supply grooves c and d lubricates between the rotatably-installed upper bearing cover 135, and the stationary shaft 141 and the eccentric portion 142.

Figure 7:
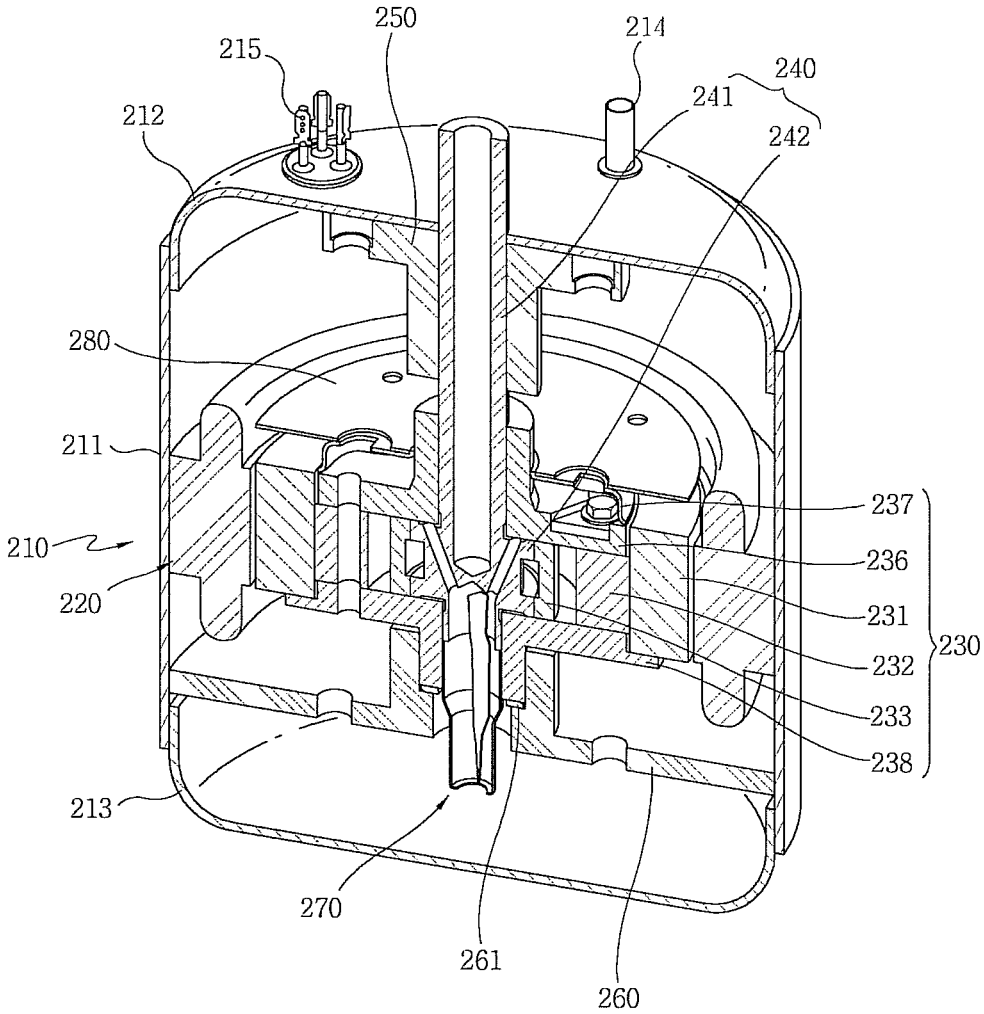
FIG. 7 is a side-sectional view of a second embodiment of the compressor according to the present invention.
Figure 8:
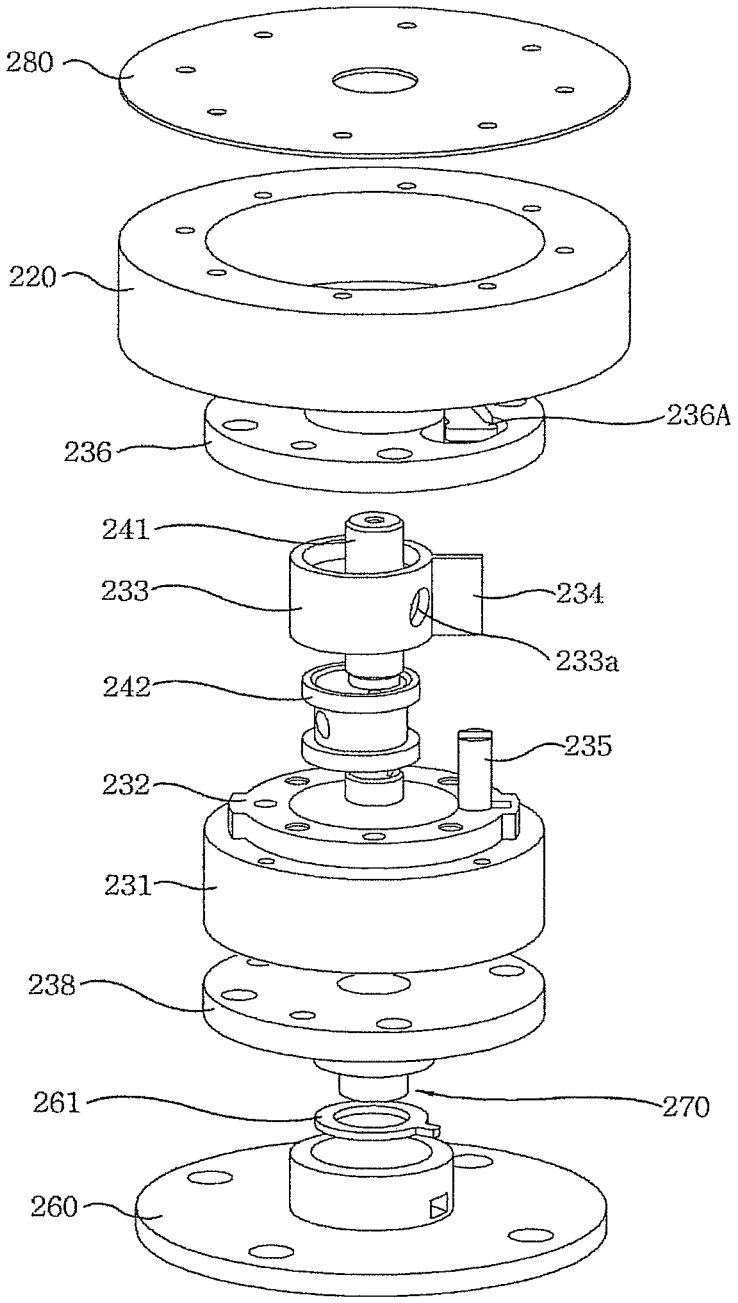
FIG. 8 is an exploded perspective view of the second embodiment of the compressor according to the present invention.
Figure 9:
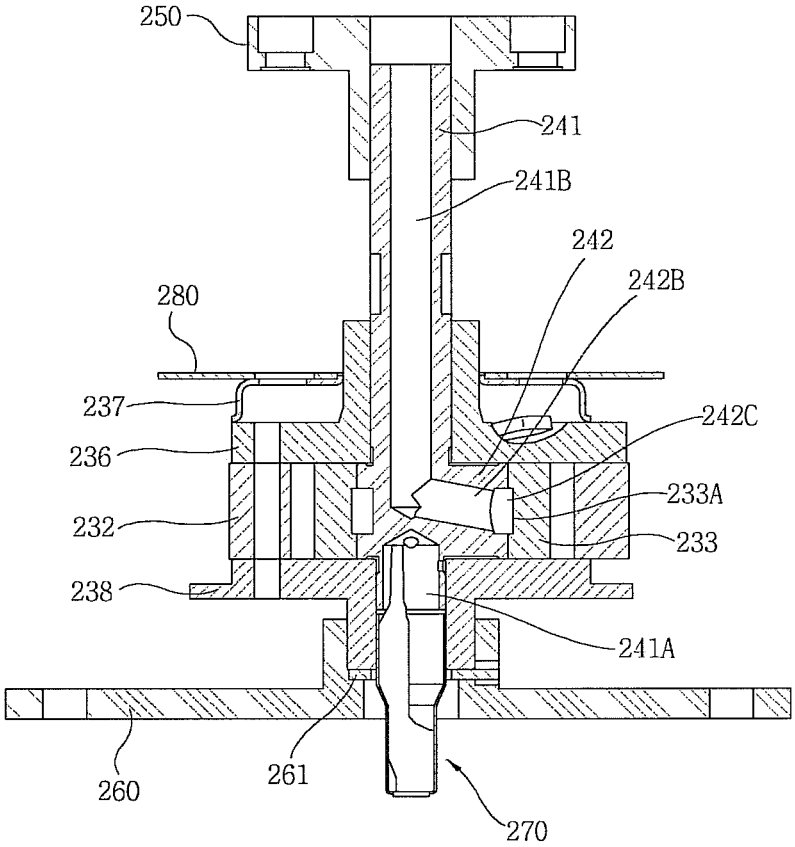
FIG. 9 is a side-sectional view of the second embodiment of the compressor according to the present invention.

FIGS. 7 to 9 are views of a second embodiment of the compressor according to the present invention.

Like the first embodiment, as illustrated in FIGS. 7 to 9, the second embodiment of the compressor according to the present invention includes a hermetic container 210, a stator 220 fixed in the hermetic container 210, a rotary member 230 installed inside the stator 220 to be rotated by a rotating electromagnetic field from the stator 220 and compressing the refrigerant, a stationary member 240, the rotary member 230 being suspended on its outer circumferential surface, top and bottom ends of a stationary shaft 241 being immovably fixed to the hermetic container 210, an upper shaft holder 250 fixing the top end of the stationary shaft 241 to the inside of the hermetic container 210, and a lower shaft holder 260 spaced apart from the bottom end of the stationary shaft 241 and fixed to the inside of the hermetic container 210 such that the rotary member 230 is rotatably supported on its top surface. Here, a motor mechanism unit supplying power through an electrical action includes the stator 220 and a rotor 231 of the rotary member 230, and a compression mechanism unit compressing the refrigerant through a mechanical action includes the rotary member 230 and the stationary member 240. Therefore, the motor mechanism unit and the compression mechanism unit are installed in the radial direction, which reduces the overall height of the compressor.

Like the hermetic container 110 of the first embodiment, the hermetic container 210 includes a body portion 211 and upper and lower shells 212 and 213. The compressor is implemented as a high-pressure type such that the high-pressure refrigerant is filled in the hermetic container 210. That is, the stationary shaft 241 is provided in the center of the upper shell 212 to be exposed therefrom, which is an example of a suction pipe through which the refrigerant is sucked, a discharge pipe 214 through which the high-pressure refrigerant is discharged is provided at one side of the upper shell 212, and a terminal 215 is provided to supply power to the stator 220. Here, there is no need that the stationary shaft 241 should excessively protrude to the outside of the hermetic container 210. Preferably, an appropriate fixing structure is installed on the outside of the hermetic container 210 and connected to an external refrigerant pipe.

The stator 220 is identically constructed as that of the first embodiment, and thus its detailed description will be omitted.

The rotary member 230 includes a cylinder-type rotor 231 and 232, a roller 233, a vane 234, a bush 235, an upper bearing cover 236 and a muffler 237, and a lower bearing cover 238. The cylinder-type rotor 231 and 232 includes a rotor 231 having a plurality of permanent magnets in the axial direction to be rotated by the rotating electromagnetic field from the stator 220, and a cylinder 232 located inside the rotor 231, integrally rotated with the rotor 231 and having a compression space therein. The rotor 231 and the cylinder 232 may be separately formed and shape-matched or integrally formed in the form of a powder-sintered body or an iron piece-stacked body. The roller 233 is formed in a cylindrical shape and rotatably mounted on an outer circumferential surface of an eccentric portion 242 of the stationary member 240 explained below. For this purpose, it is preferable to apply a lubrication structure to between the roller 233 and the eccentric portion 242. Here, vertical suction passages 233A and 242C through which the refrigerant can be sucked are provided between the roller 233 and the eccentric portion 242, and an inlet port 233*a* is provided in the roller 233 to communicate with the suction guide passages 233A and 242C. The vane 234 is integrally formed on an outer circumferential surface of the roller 233 to be expanded in the radial direction and located at one side of the inlet port 233*a* of the roller 233, and fitted into a vane mounting hole 232H provided in an inner circumferential surface of the cylinder-type rotor 231 and 232 or the cylinder 232. The bushes 235 are installed to support both sides of an end portion of the vane 234 fitted into the vane mounting hole 232H of the cylinder-type rotor 231 and 232. A lubrication structure is applied such that the vane 234 is smoothly moved between the vane mounting hole 232H of the cylinder-type rotor 231 and 232 and the bushes 235.

The upper bearing cover 236 and the muffler 237, and the lower bearing cover 238 are coupled to the cylinder-type rotor 231 and 232 in the axial direction, define a compression space between the cylinder-type rotor 231 and 232, and the roller 233 and the vane 234, and are in journal-bearing or thrust-bearing contact with the stationary member 240. In addition, an outlet port (not shown) through which the refrigerant compressed in the compression space can be discharged and a discharge valve 236*a* installed thereon are provided at the upper bearing cover 236. Preferably, the outlet port of the upper bearing cover 236 is located adjacent to the vane 233 to reduce the dead volume. The muffler 237 is coupled to a top surface of the upper bearing cover 236, and a discharge chamber which can reduce the noise caused by the opening and closing of the discharge valve 236*a* and the noise caused by the flow of the high-pressure refrigerant is provided between the upper bearing cover 236 and the muffler 237 to communicate with outlet ports (not shown) provided in the upper bearing cover 236 and the muffler 237, respectively. The upper bearing cover 236 and the muffler 237 are coupled to a top surface of the cylinder-type rotor 231 and 232, and the lower bearing cover 237 is coupled to a bottom surface of the cylinder-type rotor 231 and 232. They are fastened to the cylinder-type rotor 231 and 232 at a time by a fastening member such as a long bolt, etc.

The stationary member 240 includes the stationary shaft 241 formed in a cylindrical shape, and the eccentric portion 242 protruding from the stationary shaft 241 in the entire radial direction of the stationary shaft 241 to have a cylindrical shape of a greater diameter than that of the cylinder of the stationary shaft 241 and eccentrically formed on the stationary shaft 241. A first oil supply passage 241A through which the oil stored in the hermetic container 210 can be supplied is formed at a lower portion of the stationary shaft 241, and a vertical suction passage 241B through which the low-pressure refrigerant can be sucked is formed at an upper portion of the stationary shaft 241. The first oil supply passage 241A and the vertical suction passage 241B are isolated from each other, which prevents the oil from being discharged with the refrigerant. The eccentric portion 242 is expanded in the entire radial direction of the stationary shaft 241. A suction guide passage 242B is extended in the radial direction of the eccentric portion 242 to an outer circumferential surface thereof to communicate with the vertical suction passage 241B of the stationary shaft 241. While the roller 233 is rotated along the outer circumferential surface of the eccentric portion 242, since the annular suction guide passages 233A and 242C are provided between the inner circumferential surface of the roller 233 and the outer circumferential surface of the eccentric portion 242, the refrigerant can be introduced into the compression space through the vertical suction passage 241B of the stationary shaft 241, the horizontal suction passage 242B of the eccentric portion 242, and the suction guide passages 233A and 242C between the roller 233 and the eccentric portion 242. Since top and bottom surfaces of the eccentric portion 242 are brought into contact with the upper and lower bearing covers 236 and 238 and operated as thrust surfaces, it is preferable to form a lubrication oil supply passage on the top and bottom surfaces of the eccentric portion 242, and since the roller 233 is rotatably installed in contact with the outer circumferential surface of the eccentric portion 242, it is preferable to form a lubrication oil supply passage inside the eccentric portion 242 to extend to the outer circumferential surface thereof.

The upper and lower shaft holders 250 and 260 have the same structure as those of the first embodiment. The upper and lower shaft holders 250 and 260 immovably fix the stationary shaft 241 to the hermetic container 210 and rotatably support the rotary member 230, and thus their detailed description will be omitted.

Figure 10:
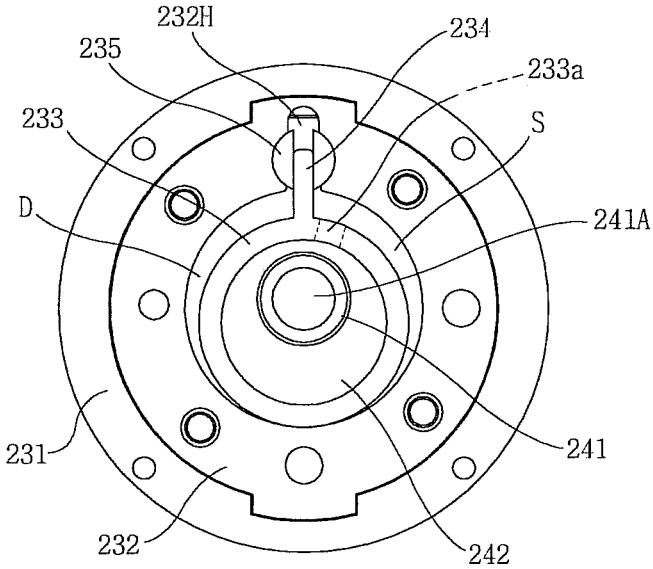
FIG. 10 is a plan-sectional view of a vane mounting structure in the second embodiment of the compressor according to the present invention.
Figure 11:
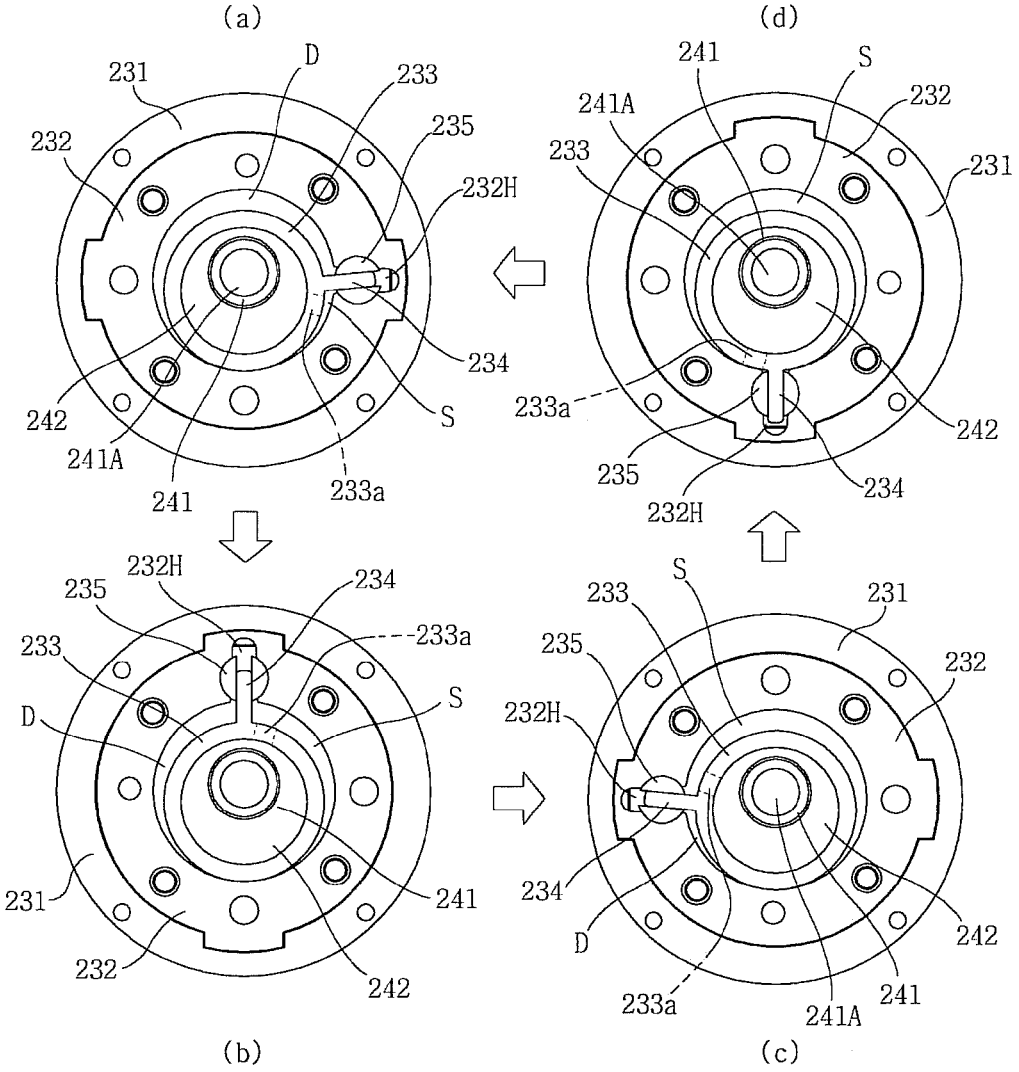
FIG. 11 is a plan view of an operation cycle of a compression mechanism unit in the second embodiment of the compressor according to the present invention.

FIG. 10 is a plan-sectional view of a vane mounting structure in the second embodiment of the compressor according to the present invention, and FIG. 11 is a plan view of an operation cycle of a compression mechanism unit in the second embodiment of the compressor according to the present invention.

The mounting structure of the vane 234 will be described with reference to FIG. 10. The vane mounting hole 232H is formed in an inner circumferential surface of the cylinder-type rotor 231 and 232 to be elongated in the radial direction and penetrated in the axial direction, the pair of bushes 235 are fitted into the vane mounting hole 232H, and the vane 234 integrally formed on an outer circumferential surface of the roller 233 is fitted between the bushes 235. Here, a compression space is defined between the cylinder-type rotor 231 and 232 and the roller 233 and divided into a suction pocket S and a compression pocket D by the vane 234. The inlet port 233*a* of the roller 233 is located at one side of the vane 234 to communicate with the suction pocket S, and the outlet port 236A (see FIG. 8) of the upper bearing cover 236 (see FIG. 8) described above is located at the other side of the vane 234 to communicate with the compression pocket D. Preferably, they are located adjacent to the vane 234 to reduce the dead volume. In the compressor of the present invention, the vane 234 integrally formed with the roller 233 is slidably assembled between the bushes 235. This can prevent a friction loss caused by sliding-contact generated in the conventional rotary compressor in which the vane separately formed from the roller or the cylinder is supported by the spring and reduce refrigerant leakage between the suction pocket S and the compression pocket D.

Accordingly, when the cylinder-type rotor 231 and 232 is applied with a rotation force by a rotating magnetic field between the rotor and the stator 220 (see FIG. 7), it is rotated. In a state where the vane 234 is fitted into the vane mounting hole 232H of the cylinder-type rotor 231 and 232, it transfers the rotation force of the cylinder-type rotor 231 and 232 to the roller 233. Here, the vane 234 is linearly reciprocated between the bushes 235 due to the rotation of the rotor and the roller. That is, an inner circumferential surface of the cylinder-type rotor 231 and 232 and an outer circumferential surface of the rotor 233 have corresponding portions. In every rotation of the cylinder-type rotor 231 and 232 and the roller 233, the corresponding portions are repeatedly brought into contact and distant positions. Therefore, the suction pocket S is gradually increased such that the refrigerant or working fluid is sucked into the suction pocket S, and the compression pocket D is gradually decreased such that the refrigerant or working fluid therein is compressed and discharged.

The suction, compression and discharge process of the compression mechanism unit will be described. As illustrated in FIG. 11, the cylinder-type rotor 231 and 232 and the roller 233 are rotated and their relative positions are changed to (a), (b), (c) and (d) during one cycle. In more detail, when the cylinder-type rotor 231 and 232 and the roller 233 are located in (a), the refrigerant or working fluid is sucked into the suction pocket S and compressed in the compression pocket D separated from the suction pocket S by the vane 234. When the cylinder-type rotor 231 and 232 and the roller 233 are rotated to reach (b), the suction pocket S is increased and the compression pocket D is decreased such that the refrigerant or working fluid is sucked into the suction pocket S and compressed in the compression pocket D. When the cylinder-type rotor 231 and 232 and the roller 233 are rotated to reach (c), the refrigerant or working fluid is continuously sucked into the suction pocket S. If the refrigerant or working fluid has a pressure over a set pressure in the compression pocket D, it is discharged through the outlet port and the discharge valve 236*a* (see FIG. 8) of the upper bearing cover 236 (see FIG. 8). The suction and discharge of the refrigerant or working fluid are almost done in (d).

Figure 12:
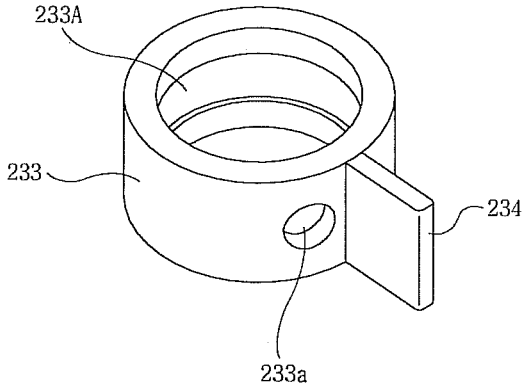
FIG. 12 is a perspective view of an example of a vane-incorporated roller in the second embodiment of the compressor according to the present invention.

FIG. 12 is a perspective view of an example of a vane-incorporated roller in the second embodiment of the compressor according to the present invention.

As illustrated in FIG. 12, the vane-incorporated roller 233 and 234 includes the cylindrical roller 233 and the vane 234 extended from an outer circumferential surface of the roller 233 in the radial direction. The vane-incorporated roller 233 and 234 is manufactured by casting using cast iron, grinding and additional machining. Here, as described above, the annular groove portion 233A is formed in an inner circumferential surface of the roller 233 such that the suction guide passages 233A and 242C (see FIG. 9) are formed in its portion engaged with the eccentric portion 242 (see FIG. 9), and the inlet port 233*a* is formed at one side of the vane 234 to communicate with the groove portion 233A. As explained above, an inner diameter of the roller 233 has an allowance of about 20 to 30 μm from an outer diameter of the eccentric portion 242 (see FIG. 9) such that the roller 233 is rotatably mounted on an outer circumferential surface of the eccentric portion 242 (see FIG. 9). Since the lubricating oil supply passage is provided on the outer circumferential surface of the eccentric portion 242 (see FIG. 9) or the inner circumferential surface of the roller 233, a loss caused by sliding-contact is seldom generated between the roller 233 and the eccentric portion 242 (see FIG. 9). As compared with the conventional rotary compressor in which the vane is elastically supported on the cylinder and brought into sliding-contact with the roller, the rotary compressor in which the roller 233 and the vane 234 are integrally formed removes the sliding loss to improve the operation efficiency and prevents the refrigerant of the suction pocket S (see FIG. 10) and the refrigerant of the compression pocket D (see FIG. 10) from being mixed between the roller 233 and the vane 234.

Figure 13:
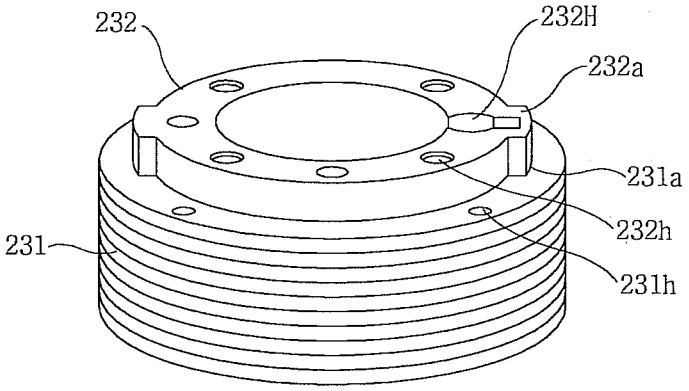
FIGS. 13 to 15 are perspective views of various embodiments of a cylinder-type rotor in the second embodiment of the compressor according to the present invention.
Figure 14:
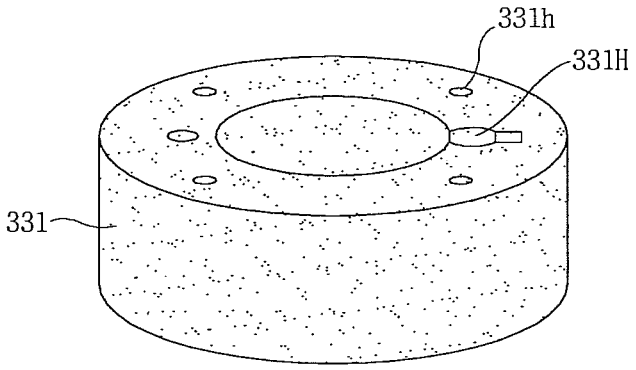
Figure 15:
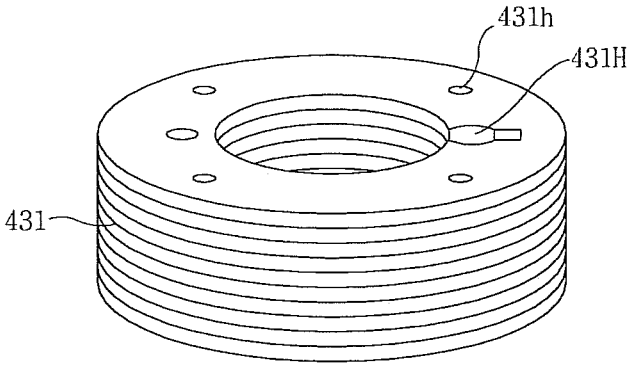

FIGS. 13 to 15 are perspective views of various embodiments of the cylinder-type rotor of the second embodiment of the compressor according to the present invention.

As illustrated in FIG. 13, in a first embodiment of the cylinder-type rotor 231 and 232, the rotor 231 and the cylinder 232 are separately formed of different materials. An outer circumferential surface of the cylinder 232 is shape-matched with an inner circumferential surface of the rotor 231 such that the rotor 231 and the cylinder 232 are integrally rotated. The rotor 231 is formed by stacking iron pieces in the axial direction such that permanent magnets (not shown) are inserted into a plurality of holes formed in the stacked body to face the stator 220 (see FIG. 8). A compression space is defined between the cylinder 232 and the roller 233 (see FIG. 8). A plurality of coupling grooves 231*a* are provided in the inner circumferential surface of the rotor 231 to shape-match the rotor 231 with the cylinder 232, and a plurality of coupling protrusions 232*a* are provided on the outer circumferential surface of the cylinder 232 to be shape-matched with the coupling grooves 231*a* of the rotor 231. The cylinder 232 is formed in a cylindrical shape with a constant thickness in the radial direction, but has a larger thickness in the radial direction in the regions of the coupling protrusions 232*a*. Accordingly, preferably, the vane mounting hole 232H provided in the inner circumferential surface of the cylinder 232 is formed in a position corresponding to one of the coupling protrusions 232*a* of the cylinder 232 for better space utilization. Meanwhile, as the rotor 231 and the cylinder 232 are separately formed, the upper bearing cover 236 (see FIG. 8) and the muffler 237 (see FIG. 8) are bolt-fastened to either the rotor 231 or the cylinder 232 and the lower bearing cover 238 (see FIG. 8) is bolt-fastened to the other, thereby obtaining a stably-fixed structure. Therefore, for the fastening of the upper bearing cover 236 (see FIG. 8) and the muffler 237 (see FIG. 8), and the lower bearing cover 238 (see FIG. 8), a plurality of bolt holes 231*h* and 232*h* are preferably formed in the rotor 231 and the cylinder 232 at regular intervals in the circumferential direction. Although the rotor 231 and the cylinder 232 are separately formed, they are integrally rotated. As such, the upper bearing cover 236 (see FIG. 8) and the muffler 237 (see FIG. 8), and the lower bearing cover 238 (see FIG. 8) may be bolt-fastened only to the cylinder 232.

In the first embodiment of the cylinder-type rotor 231 and 232, two coupling grooves 231*a* of the rotor 231 are located in the opposite directions, two coupling protrusions 232*a* of the cylinder 232 are located in the opposite directions, and the vane mounting hole 232H is formed in a position corresponding to either one of them. In addition, four bolt holes 231*h* and 232*h* are provided in the rotor 231 and the cylinder 232 at regular intervals in the circumferential direction such that the upper bearing cover 236 (see FIG. 8) and the muffler 237 (see FIG. 8), and the lower bearing cover 238 (see FIG. 8) are separately fastened to the rotor 231 and the cylinder 232.

As illustrated in FIG. 14, a second embodiment of the cylinder-type rotor 331 is integrally formed by powder sintering such that permanent magnets are inserted into a plurality of holes formed in the powder-sintered body to face the stator 220 (see FIG. 8). An outer circumferential surface provided with the permanent magnets may be considered as a rotor portion and an inner circumferential surface provided inside the rotor portion may be considered as a cylinder portion. A vane mounting hole 331H is provided in the inner circumferential surface of the cylinder-type rotor 331, and a plurality of bolt holes 331*h* are provided in the cylinder-type rotor 331 at regular intervals in the circumferential direction such that the upper bearing cover 236 (see FIG. 8) and the muffler 237 (see FIG. 8), and the lower bearing cover 238 (see FIG. 8) are bolt-fastened thereto. Since the cylinder-type rotor 331 is manufactured by powder sintering, the holes with the permanent magnets mounted therein, the vane mounting hole 331H and the bolt holes 331*h* are formed during the powder sintering.

As illustrated in FIG. 15, a third embodiment of the cylinder-type rotor 431 is formed by stacking iron pieces in the axial direction such that permanent magnets are inserted into a plurality of holes formed in the stacked body to face the stator 220 (see FIG. 7). An outer circumferential surface provided with the permanent magnets may be considered as a rotor portion and an inner circumferential surface provided inside the rotor portion may be considered as a cylinder portion. Moreover, a vane mounting hole 431H is provided in the inner circumferential surface of the cylinder-type rotor 431, and a plurality of bolt holes 431*h* are provided in the cylinder-type rotor 431 at regular intervals in the circumferential direction such that the upper bearing cover 236 (see FIG. 8) and the muffler 237 (see FIG. 7), and the lower bearing cover 238 (see FIG. 8) are bolt-fastened thereto. Since the cylinder-type rotor 431 is manufactured by stacking the iron pieces, the holes with the permanent magnets mounted therein, the vane mounting hole 431H and the bolt holes 431*h* are provided in the respective iron pieces. When these iron pieces are stacked in the axial direction, the series of holes penetrated in the axial direction, the vane mounting hole 431H and the bolt holes 431*h* are formed.

Figure 16:
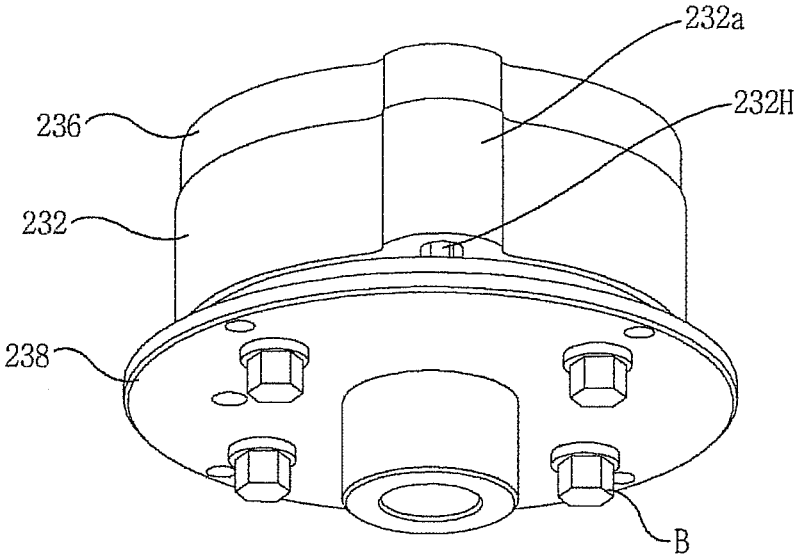
FIG. 16 is a perspective view of an upper and lower bearing cover mounting structure in the second embodiment of the compressor according to the present invention.

FIG. 16 is a perspective view of an upper and lower bearing cover mounting structure in the second embodiment of the compressor according to the present invention.

As illustrated in FIG. 16, the upper and lower bearing covers 236 and 238 are bolt-fastened to the rotor 231 (see FIG. 8) or the cylinder 232 in the axial direction. As set forth herein, if the cylinder-type rotor in which the rotor 231 (see FIG. 8) and the cylinder 232 are integrally formed is employed, the upper and lower bearing covers 236 and 238 are bolt B-fastened to the cylinder-type rotor at a time. Meanwhile, if the cylinder-type rotor in which the rotor 231 (see FIG. 8) and the cylinder 232 are separately formed is employed, the upper and lower bearing covers 236 and 238 may be bolt B-fastened to the rotor 231 (see FIG. 8) and the cylinder 232, respectively, or bolt B-fastened only to the cylinder 232. In the embodiment of the present invention, the cylinder-type rotor in which the rotor 231 (see FIG. 8) and the cylinder 232 are separately formed is employed, and the upper bearing cover 236 and the lower bearing cover 238 are bolt B-fastened to the cylinder 232, respectively. Here, the lower bearing cover 238 is installed to cover the bottom surface of the cylinder 232. Preferably, the lower bearing cover 238 is installed without covering the coupling protrusions 232*a* protruding from an outer circumferential surface of the cylinder 232 to be shape-matched with the rotor 231 (see FIG. 8) and a part of the vane mounting hole 232H provided in the coupling protrusion 232*a*. For example, a part of the lower bearing cover 238 corresponding to at least a part of the vane mounting hole 232H may be provided with a stepped portion, removed or provided with an additional oil supply hole. The oil stored in the hermetic container 210 (see FIG. 7) maintains a higher level than the lower bearing cover 238 such that the bottommost end of the vane mounting hole 232H can be immersed therein. Therefore, when the oil is introduced into the vane mounting hole 232H of the cylinder 232 which is not covered with the lower bearing cover 238, the vane 234 can be smoothly linearly reciprocated between the vane mounting hole 232H and the bushes 135.

Figure 17:
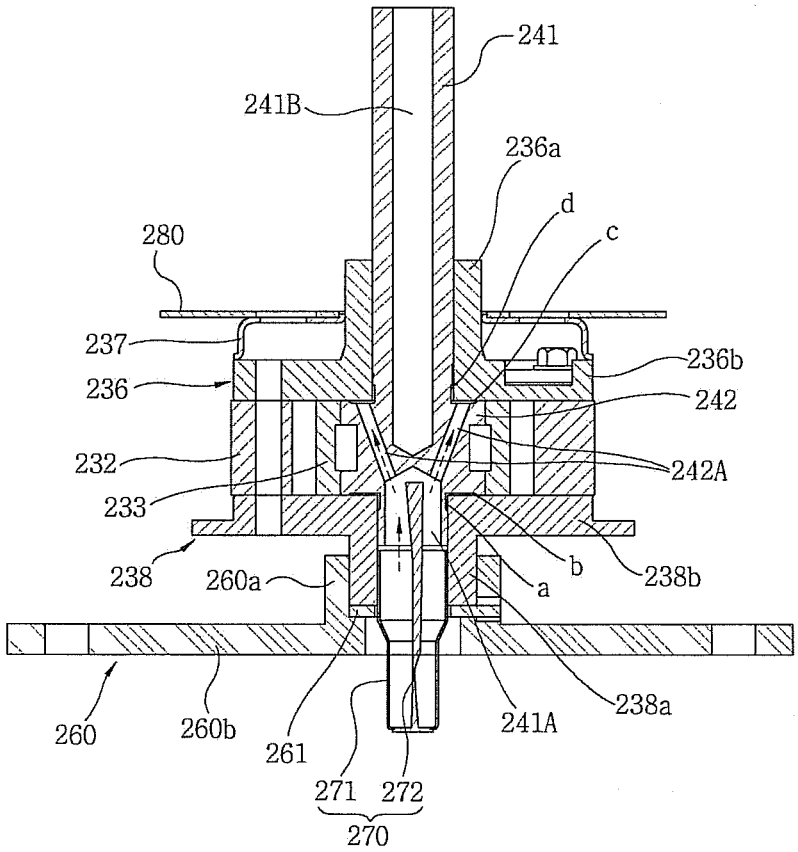
FIG. 17 is a side-sectional view of a support structure of a rotary member in the second embodiment of the compressor according to the present invention.

FIG. 17 is a side-sectional view of a support structure of the rotary member in the second embodiment of the compressor according to the present invention.

As illustrated in FIGS. 7 and 17, the rotary member 230 is rotatably suspended on the stationary member 240 and rotatably supported on the lower shaft holder 260 spaced apart from the stationary member 240. Like the first embodiment, the rotary member 230 is rotatably supported on the stationary member 240 and the lower shaft holder 260 by the upper and lower bearing covers 236 and 238. First and second journal bearings are provided on surfaces of the shaft portions 236*a* and 238*a* of the upper and lower bearing covers 236 and 238 which are brought into contact with the stationary shaft 241, respectively, first and second thrust bearings are provided on surfaces of the cover portions 236*b* and 238*b* of the upper and lower bearing covers 236 and 238 which are brought into contact with the eccentric portion 242, respectively, and a third journal bearing and a third thrust bearing are provided on surfaces of the bearing portion 260*a* of the lower shaft holder 260 which are brought into contact with the shaft portion 238*a* of the lower bearing cover 238, or a separate plate-shaped thrust bearing 261 may be provided.

The upper and lower bearing covers 236 and 238 described above are fitted onto upper and lower portions of the stationary shaft 241 in the axial direction, and then bolt B-fastened to the rotor 231 (see FIG. 8) or the cylinder 232, respectively. As set forth herein, if the cylinder-type rotor in which the rotor 231 (see FIG. 8) and the cylinder 232 are integrally formed is employed, the upper and lower bearing covers 236 and 238 are bolt B-fastened to the cylinder-type rotor at a time. Meanwhile, if the cylinder-type rotor in which the rotor 231 and the cylinder 232 are separately formed is employed, the upper and lower bearing covers 236 and 238 may be bolt B-fastened to the rotor 231 and the cylinder 232, respectively, or bolt B-fastened only to the cylinder 232. In the embodiment of the present invention, the cylinder-type rotor in which the rotor 231 and the cylinder 232 are separately formed is employed, and the upper bearing cover 236 and the muffler 237, and the lower bearing cover 238 are bolt B-fastened to the cylinder 232, respectively. Therefore, when the rotary member 230 is coupled to the stationary member 240, the lower shaft portion 236*b* of the lower bearing cover 236 is fitted into the lower shaft holder 260, the top end of the stationary shaft 241 is fitted into the upper shaft holder 250, and the upper and lower shaft holders 250 and 260 are fixedly welded to the hermetic container 210, respectively.

As described above, also in the second embodiment, a lubrication structure for supplying the oil is provided on contact surfaces of the rotary member 230 and the stationary member 240. As in the first embodiment, the lubrication structure includes a first oil supply passage 241A provided in a lower portion of the stationary shaft 241, an oil supply hole provided in a lower portion of the stationary shaft 241, second oil supply passages 242A provided in the eccentric portion 242, and first and second oil supply grooves a, b, c and d provided in the stationary shaft 241 and the eccentric portion 242 brought into contact with the upper and lower bearing covers 236 and 238. The lubrication structure of the second embodiment is identical in construction and operation as that of the first embodiment, and thus its detailed description will be omitted.

The present invention has been described in connection with the exemplary embodiments and the accompanying drawings. However, the scope of the present invention is not limited thereto but is defined by the appended claims.

The invention claimed is:

1. A compressor, comprising;

a hermetic container into and from which a refrigerant is sucked and discharged;

a stator fixed to an inner surface of the hermetic container;

a first stationary member including a stationary shaft having a first end immovably installed in a first portion of the hermetic container and being elongated in the hermetic container and an eccentric pardon eccentric from a center of the stationary shaft;

a second stationary member spaced apart from a second end of the first stationary member and immovably installed in a second portion of the hermetic container; and a rotary member located inside the stator, including a cylinder-type rotor rotated around the stationary shaft by a rotating electromagnetic field from the stator, a roller applied with a rotational force of the cylinder-type rotor, rotated around the eccentric portion with the cylinder-type rotor, a compression space being defined between the roller and the cylinder-type rotor, a vane fixedly formed on the roller to protrude from an outer circumferential surface of the roller to the cylinder-type rotor, transfer the rotational force from the cylinder-type rotor to the roller, and partition the compression space into a suction pocket, into which the refrigerant is sucked, and a compression pocket, into and from which the refrigerant is compressed and discharged, and first and second bearing covers that form first and second portions of the compression space and rotate around the first stationary member with the cylinder, wherein a vane mounting hole is provided in the cylinder-type rotor to accommodate the protruding vane, and wherein the rotary member is rotatably supported by applying a load to the second stationary member.

2. The compressor of claim 1, wherein the cylinder-type rotor comprises a cylinder that defines the compression space, between the cylinder and the roller, and a rotor formed by staking iron pieces in an axial direction of the rotor, wherein permanent magnets are inserted into a plurality of holes formed in the rotor so formed that face the stator, and wherein the cylinder and the rotor correspond in shape.

3. The compressor of claim 1, wherein a bush that guides side surfaces of the vane linearly reciprocated with the rotation of the cylinder-type rotor is provided in the vane mounting hole, and wherein at least a portion of the vane mounting hole is not covered with the second bearing cover such that oil stored in the hermetic container is supplied to the vane mounting hole.

4. The compressor of claim 1, wherein the first beating cover comprises a shaft portion that encloses the stationary shaft and a cover portion coupled to the cylinder to form the first portion of the compression space, wherein an inner circumferential surface of the shaft portion is rotatably journal-supported on an outer circumferential surface of the stationary shaft, and wherein a surface of the cover portion is rotatably thrust-supported on a surface of the eccentric portion.

5. The compressor of claim 1, wherein the second bearing cover comprises a shaft portion that encloses the stationary shaft and a cover portion coupled to the cylinder to form the second portion of the compression space, wherein an inner circumferential surface of the shaft portion is rotatably journal-supported on an outer circumferential surface of the stationary shaft, and a surface of the cover portion is rotatably thrust-supported on a surface of the eccentric portion.

6. The compressor of claim 5, wherein the hermetic container is formed in the shape of a cylinder with a circular cross-section, and wherein the second stationary member is fixed to one or more of side and bottom surfaces of the hermetic container by welding.

7. The compressor of claim 5, wherein the shaft portion extends more than an end of the stationary shaft in an axial direction, and an end portion of the shaft portion is rotatably supported by applying a load of the rotary member to the second stationary member.

8. The compressor of claim 7 wherein the second stationary member further comprises a cylindrical bearing portion having a stepped portion, wherein an end portion of the shaft portion is thrust supported on the stepped portion of the second stationary member, and wherein an outer circumferential surface of the shaft portion is journal-supported on an inner circumferential surface of the cylindrical bearing portion.

9. The compressor of claim 8, wherein a separate thrust bearing member is provided between the end portion of the shaft portion and the stepped portion of the second stationary member.

10. The compressor of claim 8, further comprising a shaft holder provided on a surface of the hermetic container such that an end of the stationary shaft is fixed thereto.

* * * * *